United States Patent [19]

Itzrodt

[11] 4,406,066

[45] Sep. 27, 1983

[54] POWER SAW

[75] Inventor: Gerd Itzrodt, Stuttgart, Fed. Rep. of Germany

[73] Assignee: Andreas Stihl, Waiblingen, Fed. Rep. of Germany

[21] Appl. No.: 298,957

[22] Filed: Sep. 3, 1981

[30] Foreign Application Priority Data

Sep. 6, 1980 [DE] Fed. Rep. of Germany ..... 3033604

[51] Int. Cl.[3] ..... B27B 17/00

[52] U.S. Cl. ..... 30/382; 123/179 G

[58] Field of Search ..... 30/381, 382, 382, 384; 123/179 G, 398

[56] References Cited

U.S. PATENT DOCUMENTS 4,028,804 6/1977 Hammond ..... 30/382

4,302,880 12/1981 Elfving ..... 30/382

*Primary Examiner*—Jimmy C. Peters

*Attorney, Agent, or Firm*—Becker & Becker, Inc.

[57] ABSTRACT

A power saw having a throttle lever which is pivotally mounted on a handle, and having a throttle-knob for starting. In order to lock the throttle lever in a position in which the throttle is partially open, the throttle-knob for starting can be shifted by means of a blocking movement into the region of the path along which the throttle lever pivots. At least one additional movement precedes the blocking movement of the throttle-knob for starting, this additional movement preferably being a rotary movement which is directed about an axis of the throttle-knob for starting, and is directed essentially at right angles to the blocking movement.

12 Claims, 6 Drawing Figures

1
2
3
4
5
6
7
8
9
24
25
34
35
36
37
38
39
40
41
42
43
44
45
46
VI

POWER SAW

The present invention relates to a power saw having a throttle lever which is pivotably mounted on a handle, and having a throttle-knob for starting, which, in order to lock the throttle-lever in a position in which the throttle is partially open, can be shifted, by means of a blocking movement, into the region of the path along which the throttle lever pivots.

In order to start a cold power saw of this type, it is necessary to close the choke and, furthermore, to open the throttle valve slightly beyond the normal idling position. The latter is effected by pulling the throttle lever into an approximate position in which the throttle is partially open, and by locking the lever in this position by means of a throttle-knob for starting, it being possible to shift this knob, by means of a simple slide/-blocking movement, into the region of the path along which the throttle lever pivots, essentially at right angles to its pivoting movement. After the power saw has started, the choke is opened and the locking of the throttle lever is released, so that the latter can be moved freely, for normal operation, in the range between the idling position and the full-throttle position. Due to the simple idling movement of the throttle-knob for starting, there is a danger of this knob being moved, for example by the operator, unintentionally, or even also by a foreign body, into a position causing the power saw to run, at the moment of danger, at a high speed, with a consequent risk of injuries.

It is therefore an object of the present invention to improve a power saw of the type initially described in such a way that increased safety is achieved when working with this saw.

This object, and other objects and advantages of the present invention, will appear more clearly from the following specification in connection with the accompanying drawings in which.

Figures 1, 2:
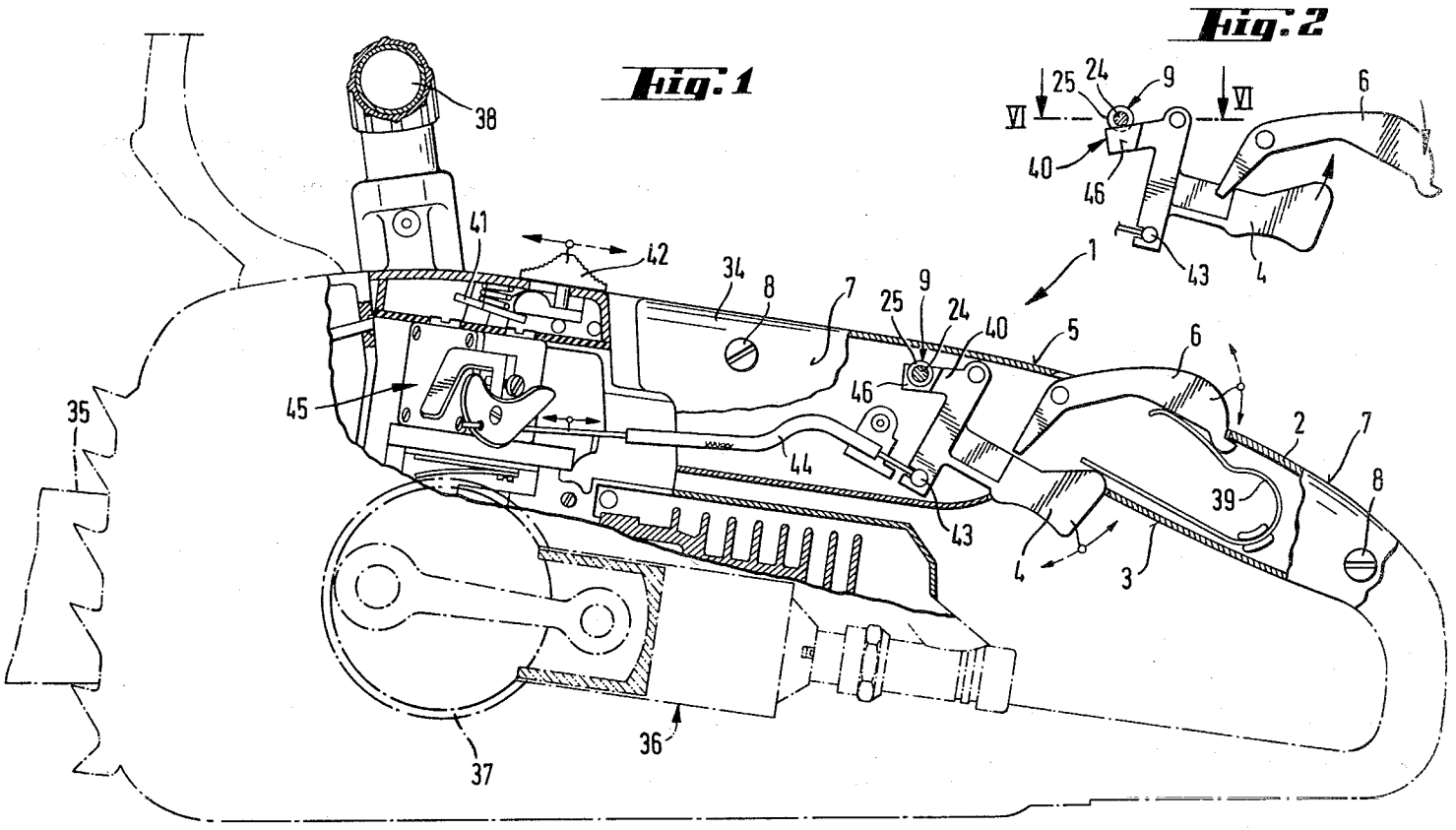
FIG. 1 shows a power saw, according to one embodiment of the present invention, partially diagrammatically and partially in section, in the unlocked position, i.e., in the initial position, which corresponds to the idling position.
FIG. 2 shows the lever arrangement according to FIG. 1, in the locked position, i.e., in the starting position.

The power saw of the present invention is characterized primarily in that at least one additional movement precedes the blocking movement of the throttle-knob for starting.

According to preferred embodiments and further developments of the present invention, the additional movement of the throttle-knob for starting may be directed essentially at right angles to the blocking movement, and is preferably a rotary movement directed about an axis of the throttle-knob for starting.

The additional movement of the throttle-knob for starting may be directed against the force of a spring, which is preferably designed as a helical torsion/compression spring, one end of which is located in a hole drilled in one end-face of a journal, and the other end of which is located in a hole in a bottom wall of a bore for the journal.

The additional movement of the throttle-knob for starting and its blocking movement, may be separated by means of a guide-part which can preferably be shifted inside a guide-recess during the blocking movement of the throttle-knob for starting.

The guide-part may be located on a rotatable journal, which can be shifted axially inside a bore in the handle, the guide-recess being formed in a peripheral wall of the bore.

A recess having the shape of a sector of a circle may be formed in the peripheral wall of the bore, this recess receiving the guide-part and having a stop for the guide-part, which stop is preferably located with a radial offset of approximately 90° with respect to the guide-recess in the peripheral wall.

A coaxial journal extension may be located on the journal, this extension passing through the spring and having a blocking collar in the region of its free end.

The blocking collar may have a conical taper in the direction of the blocking movement of the throttle-knob for starting, and preferably engages or overlaps the bottom wall on a lateral surface which faces away from the bore.

The throttle-knob for starting has a grip-part at that end-region of the journal located in front of the guide-opening, this grip-part preferably being designed with an essentially circular shape and having peripheral knurling.

The grip-part, which is preferably designed in the form of a lever, has a conical taper running in a direction opposite to the blocking movement of the throttle-knob for starting.

By means of the invention, the advantage is obtained that the throttle-knob for starting cannot be moved by a simple linear movement, without further action, since an additional safety-manipulation must precede the actual blocking movement travel of the throttle-knob for starting, before the said knob can engage, to any extent, into the path along which the throttle lever pivots. In practical terms, it is accordingly necessary to move the throttle-knob for starting in two separate phases in order to lock the throttle lever. A significant increase in safety is thereby achieved, since the throttle-knob for starting cannot any longer be inadvertently moved by the operator during operation, and it is also impossible for any effect, caused by a foreign body, acting from the outside, or caused by an unintentional blow against another object, to bring about an unintended locking of the throttle lever. Should a force act on the throttle-knob for starting, in the direction of the blocking movement, the knob cannot be moved from its normal operating position in which its blocking action is cancelled, since a compulsory additional movement must initially be applied, according to the invention, to the throttle-knob starting.

By shifting the throttle-knob for starting over at least two sequentially coupled movement-directions, or operation-directions, unintentional operation is consequently almost completely prevented. In the case of the design in question, it is possible to sequentially couple movement-direction running for example, in a straight line, or also to couple two sequential rotary movements. Furthermore, in the case of a preferred embodiment, it can be advantageous to precede the pressing blocking movement of the throttle-knob for starting by a rotatable additional movement. It can, however, also be advantageous to add a sliding movement in advance of the pressing blocking movement of the throttle-knob for starting.

The details of the design and shape of the actuating part of the throttle-knob for starting, which is to be gripped by the operator's hand can be matched to the corresponding arrangement on the power saw, and according to the corresponding ways in which the saw can be operated, it being possibly advantageous to provide knurling, a thumb-recess, or a lever.

Referring now to the drawings in detail, the inventive power saw 1 essentially comprises a casing or housing 34, in which a projecting cutting unit or guide bar 35 is bolted, this part having a revolving saw-chain (not illustrated). The casing 34 surrounds an internal combustion engine 36 for driving the saw-chain, and a clutch-drum 37 of a centrifugal clutch, this drum being mounted so that it can rotate. A handle 2 and a carrying handle 38, located at right angles to the guide bar 35, are additionally secured to the casing 34.

Figure 3:
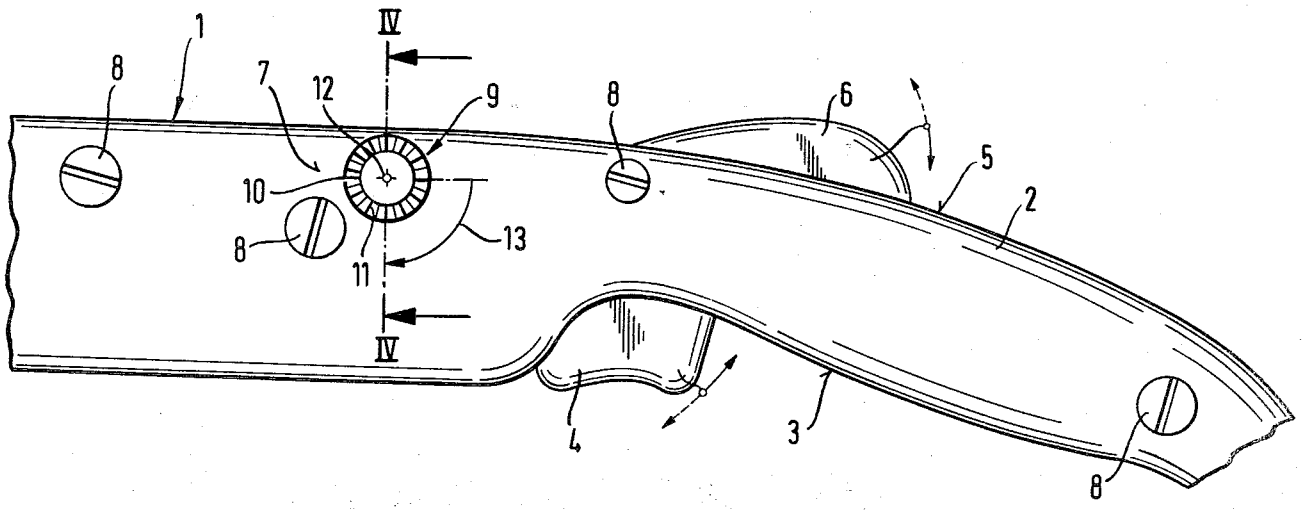
FIG. 3 shows an enlarged side view of a handle of the power saw according to FIG. 1.

As FIGS. 1 and 3 show, the handle 2 has on its underside 3, a pivotably mounted throttle lever 4; a throttle lever locking device 6, which can be pressed in, is oppositely located on the upper side 5 of the handle 2. The throttle lever 4 and the throttle lever locking device 6 are spring-loaded by means of a spring 39. A Bowden cable 44 is connected to the throttle lever 4 at 43 and leads to a carburetor 45. Both the locking device and the spring are in their initial position, which corresponds to the idling position of the throttle lever 4. In this position, the throttle lever 4 is prevented from pivoting by means of the throttle lever locking device 6. In order to increase the engine speed, the throttle lever 4 can only be operated if the throttle lever locking device 6 is pressed into the handle 2. In practice, this action is effected when the operator, working with the power saw 1, presses the throttle lever locking device 6 downwards with the thumb of one hand, and pivots the throttle lever 4 with the index finger of this hand in order to set the engine speed required at the time in question, setting being effected in an infinitely variable manner.

A throttle-knob 9 for starting is located on one side-wall 7 of the handle 2, which is held together, in the case of the present embodiment, by means of screws 8. This throttle-knob 9 has a circular grip-part 10 (FIG. 3), the exterior of which is provided with peripheral knurling 11. The inventive throttle-knob 9 for starting can execute an additional movement 13, in which it rotates through 90° about an axis 12.

Figure 4:
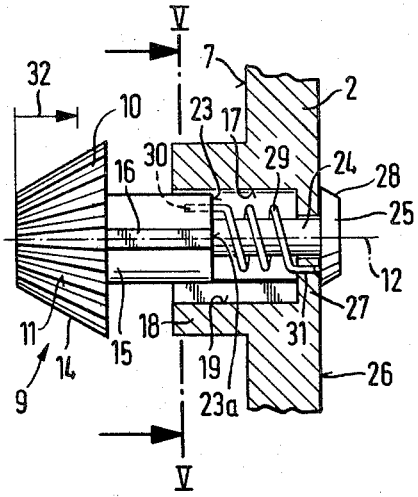
FIG. 4 shows an enlarged representation of a throttle-knob for starting, associated with the handle according to FIG. 3, partially in side view and partially in section, and taken along line IV—IV.
Figure 5:
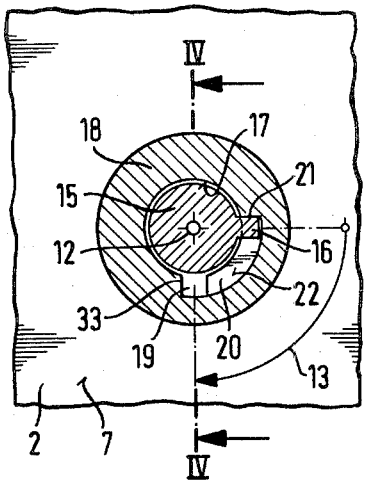
FIG. 5 is a section taken along line V—V in FIG. 4.
Figure 6:
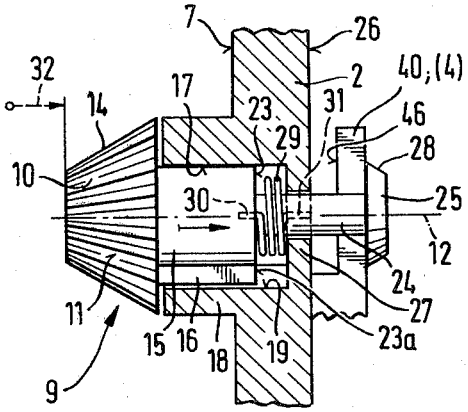
FIG. 6 shows a throttle-knob for starting, associated with the handle according to FIG. 3, in the locking position (position in which the throttle is partially open, starting position), and is taken along line VI—VI of FIG. 2.

As shown in FIGS. 4–6, the grip-part 10 has a conical taper 14 which is directed away from the side-wall 7, and is located at one end-region of a bearing-journal 15. The journal 15 has a guide-part 16 which projects above its peripheral surface, is designed as a web having a rectangular cross-section, and extends parallel to the axis 12. The journal 15 is mounted in a bore 17 of the side-wall in a manner allowing both rotation and axial shifting. A guide-recess 19 is formed in the peripheral wall 18 of the bore 17, this recess being configured as a longitudinal groove having a rectangular shape, the cross-section of this guide-recess being slightly larger than the cross-section of the guide-part 16. In addition, a recess 20, having the shape of a sector of a circle, is provided in the peripheral wall 18 of the bore 17, in the front region of the side-wall 7, in which recess the guide-part 16 is located when the throttle-knob 9 for starting is in the unlocking position illustrated, and in which the guide-part 16 rests against a stop 21 of the recess 20. The recess 20, which has the shape of a sector of a circle, is bounded, in the peripheral wall 18, in the direction at right angles to the axis 12, by a bottom surface 22. The stop of the recess 20 is offset by 90° with respect to the guide-recess 19 in the peripheral wall 18, as a result of which the additional movement 13 of the throttle-knob 9 for starting can be executed in this angular range and is limited to this range.

A journal-extension 24 is located on that end-face 23 of the journal 15 which is remote from the grip-part 10, this extension having a smaller diameter, and having a blocking collar 25 in the region of its free end. The blocking collar 25 rests against an inner side surface 26 of a bottom wall 27 of the bore 17, and has a conical taper 28 extending in the opposite direction to the conical taper 14 of the grip-part 10. In the region of the bore 17, between the bottom wall 27 of the bore and the end-face 23 of the journal 15, the extension 24 is surrounded by a spring 29. The spring 29 is designed as a helical torsion/compression spring. One of the ends of this spring is immovably mounted in a hole 30, drilled in the end-face 23 of the journal 15, and its other end is immovably mounted in a hole 31 in the bottom wall 27. The spring 29 consequently has two force-directions, running parallel to the axis 12, one towards the end-face of the journal 15, and the other in the opposite direction for the purpose of the additional movement 13. By virtue of this arrangement, the throttle-knob 9 for starting is pushed, by the force of the spring 29, away from the side-wall 7 and into its unlocking position, while the guide-part 16 is simultaneously pushed against the stop 21 of the recess 20.

The throttle-knob 9 for starting can be shifted axially, against the force of the spring 29, by means of a blocking movement 32 which is directed parallel to the axis 12. However, the additional movement 13 precedes this blocking movement 32, with the additional movement being directed, as a rotary movement, essentially at right angles to the blocking movement 32. Unintentional incorrect operation of the throttle-knob 9 for starting is thereby rendered impossible, and a significant increase in safety is provided while working with the power saw 1. In consequence of the design solution according to the present invention, it is therefore necessary, when starting the power saw 1 to first carry out the additional movement 13 at the throttle-knob 9 for starting, in order to lock the throttle lever 4, until the guide-part 16 is stopped by the rotation-limiting surface 33 (FIG. 5), and at the same time is located in front of the guide-recess 19. The blocking movement 32 is then carried out (FIG. 6) in a second phase, the guide-part 16 sliding longitudinally in the guide-recess 19. At the end of the blocking movement 32, the blocking collar 25 is located in the region through which the throttle lever 4 pivots, and locks this lever in a position in which the throttle is partially open by engaging behind a corresponding projection 40 (FIGS. 2;6). This position preferably corresponds to the half-throttle position, in which the throttle lever 4 is pivoted only into an intermediate position, compared to the full-throttle position. In this position, in which the throttle is partially open, the engine of the power saw 1 can be started, provided that the choke 41 is shifted by means of the switch 42 (FIG. 1). After the engine has started, the choke 41 is opened again, and, by briefly opening the throttle by means of the throttle lever 4, the lever is unlocked by the outward pivoting of the extension 40. At the same time, the throttle-knob 9 for starting springs back, due to the force of the spring 29, in the direction opposite to the blocking movement 32. As soon as the guide-part 16 has left the guide-recess 19, the throttle-knob 9 for starting pivots back into its initial position, in the opposite direction to the arrow marking the direction of the additional movement 13. If, in the position illustrated, only one force is exerted on the throttle-knob 9 for starting, in the direction of the blocking movement 32, pressing-in of this knob is prevented, due to the fact that the end-face 23*a* of the guide-part 16, which is located in the same plane with the end-face 23 of the journal 15 and separates the additional movement 13 from the blocking movement 32, strikes the bottom surface 22 of the recess 20, which has the shape of a sector of a circle, and consequently prevents the throttle-knob 9 for starting from being shifted axially. Consequently, in order to operate the throttle-knob 9 for starting, it is always necessary first to carry out the additional movement 13 which, according to the invention, precedes the blocking movement 32. The projection 40 has a recess 46, which corresponds to the height of the blocking collar 25, so that the throttle lever 4/40 can override this collar in the position according to FIGS. 1 and 4.

The present invention is, of course, in no way restricted to the specific disclosure of the specification and drawings but also encompasses any modifications within the scope of the appended claims.

What I claim is:

1. A power saw, including a housing and a handle mounted thereto, said power saw including:

a throttle lever pivotally mounted to said handle;

a throttle lever locking device operatively associated and connectible with said throttle lever; and a throttle-knob movable for starting, said throttle-knob being mounted to said handle in such a way as to be movable in a two-phase operating sequence including at least one first additional movement, and only then to be movable in a separate second blocking movement, into the region of the path along which said throttle lever pivots, in order to lock said throttle lever safely in a partially open throttle position, said throttle-knob itself thus carrying out two sequential movements separate from each other and also independent of the movement of said throttle lever locking device.

2. A power saw according to claim 1, in which said first additional movement of said throttle-knob for starting is directed essentially at right angles to said separate second blocking movement thereof.

3. A power saw, including a housing and a handle mounted thereto, said power saw including:

a throttle lever pivotally mounted to said handle; and a throttle-knob for starting, said throttle-knob being mounted to said handle in such a way as to be movable in at least one first movement, and only then to be movable in a second blocking movement, into the region of the path along which said throttle lever pivots, in order to lock said throttle lever in a partially open throttle position, said first movement of said throttle-knob for starting being directed essentially at right angles to said blocking movement thereof, said first movement of said throttle-knob being a rotary movement directed about an axis of said throttle-knob.

4. A power saw according to claim 3, in which said handle is provided with a bore, and in which said throttle-knob for starting includes a journal displaceably and rotatably mounted in said bore, and a grip-part which is mounted to one end of said journal, with the diameter of said bore at that side of said handle remote from said grip-part being less than the diameter of said bore at the opposite side of said handle, so that a bottom wall is formed remote from said grip-part, the other end of said journal, which other end is remote from said grip-part, faces said bottom wall, and which a spring mounted between said bottom wall and said other end of said journal, said first movement of said throttle-knob being directed against the force of said spring.

5. A power saw according to claim 4, in which said spring is a helical torsion/compression spring having a first and second end, said first end being mounted in that other end of said journal remote from said grip-part, and said second end being mounted in said bottom wall.

6. A power saw according to claim 4, in which said journal is provided with a guide-part for segregating said first and second movements of said throttle-knob.

7. A power saw according to claim 6, which includes a first recess in the peripheral wall of said bore, said guide-part being shiftable in said first recess during said second blocking movement of said throttle-knob.

8. A power saw according to claim 7, which includes a second recess, having the shape of a sector of a circle, in the peripheral wall of said bore, said guide-part being shiftable in said second recess at right angles to said first recess during said first movement of said throttle-knob, one end of said second recess being in communication with said first recess, a stop being provided in said peripheral wall of said bore at that end of said second recess remote from, and 90° radially offset from, said first recess.

9. A power saw according to claim 8, which includes a journal extension which is coaxial with said journal and passes through said spring, one end of said extension being connected to said other end of said journal which faces said bottom wall and is remote from said grip-part, the other end of said extension extending through said bottom wall and being provided with a blocking collar.

10. A power saw according to claim 9, in which said blocking collar is provided with a conical taper which narrows in a direction away from said journal, i.e., in the direction of said second blocking movement of said throttle-knob, said blocking collar overlapping that side of said bottom wall remote from said journal.

11. A power saw according to claim 9, in which said first recess is arranged between said grip-part and said bottom wall, and in which said grip-part is essentially circular and has a peripheral knurling.

12. A power saw according to claim 11, in which said grip-part is in the form of a lever and is provided with a conical taper which narrows in a direction away from said journal, i.e., counter to the direction of said second blocking movement of said throttle-knob.

* * * * *